US011994124B1

(12) United States Patent
Guy

(10) Patent No.: US 11,994,124 B1
(45) Date of Patent: May 28, 2024

(54) SYSTEM OF GAS COMPRESSION UTILIZING VARIABLE INPUT PRESSURES TO PRODUCE A CONSISTENT OUTPUT PRESSURE

(71) Applicant: Evan Scott Guy, Magnolia, TX (US)

(72) Inventor: Evan Scott Guy, Magnolia, TX (US)

( * ) Notice: Subject to any disclaimer, the term of this patent is extended or adjusted under 35 U.S.C. 154(b) by 0 days.

(21) Appl. No.: 18/338,735

(22) Filed: Jun. 21, 2023

(51) Int. Cl.

| | |
|---|---|
| ***F04B 49/22*** | (2006.01) |
| ***F04B 25/02*** | (2006.01) |
| ***F04B 49/00*** | (2006.01) |
| ***F04B 49/20*** | (2006.01) |

(52) U.S. Cl.
CPC ..... *F04B 49/22* (2013.01); *F04B 25/02* (2013.01); *F04B 49/007* (2013.01); *F04B 49/20* (2013.01)

(58) Field of Classification Search
CPC ..... F04B 25/02; F04B 49/007; F04B 49/22; F04B 49/20
See application file for complete search history.

(56) References Cited

U.S. PATENT DOCUMENTS

| | | | | |
|---|---|---|---|---|
| 4,368,008 A * | 1/1983 | Budzich | F04B 25/02 417/267 |
| 4,480,654 A * | 11/1984 | Firey | F04B 41/02 417/442 |
| 5,238,372 A * | 8/1993 | Morris | F01L 25/06 417/393 |
| 10,443,586 B1 * | 10/2019 | Sahm | F04B 49/08 |
| 2018/0314274 A1 * | 11/2018 | Gibbs | F04B 49/22 |

* cited by examiner

*Primary Examiner* — Bryan M Lettman

(57) ABSTRACT

A system for compressing gas, including fugitive natural gas emissions from natural gas compression equipment, such that the gas can be reintroduced in an unchanged, undiluted state into a pressurized gas pipeline system such as that used for natural gas. The source of gas can include leakage from natural gas compressor piston rod packing seals, or blowdowns of certain sections of a natural gas pipeline system for purposes of maintenance or emergency operations, or any other leakage source. The current practice within the natural gas pipeline industry is to vent or flare fugitive emissions and blowdown gas to atmosphere.

6 Claims, 10 Drawing Sheets

SYSTEM OF GAS COMPRESSION UTILIZING VARIABLE INPUT PRESSURES TO PRODUCE A CONSISTENT OUTPUT PRESSURE

PRIOR ART

Gas is compressed to increase its density for the purpose of well production, transportation, and distribution. Gas compressors are typically one to three stage double-acting reciprocating-piston compressors, depending on the amount of compression required for a specific installation.

Natural gas compressors are found at gas wellhead locations and throughout pipelines that transport gas. Typically, these compressors are driven by reciprocating-piston internal-combustion engines. These use natural gas as fuel as it is readily available. Compressors may also be driven by turbine engines or electric motors.

Natural gas compressors leak natural gas between the piston rod and packing seals. The leakage rate is a function of pressure differential across the seals and hardware conditions. The emissions from these leaks are allowed to escape to atmosphere.

Natural gas compressors and compressor stations (containing multiple compressors), also perform "blow-down" events to de-pressurize components, compressors, and sections of piping for the purpose of load reduction for engine starting, maintenance, or failure.

In recent years, global climate change resulting from human activity has become apparent. Gradual global warming is beginning to result in scientifically documented changes in weather patterns, ocean temperatures, and a long list of weather-related changes, many of which have an increasingly adverse effect on earth's environment. Scientists have identified specific gases, termed greenhouse gasses (GHGs), which have the detrimental effect of trapping heat within the earth's atmosphere. Methane, the predominant constituent in natural gas, is particularly damaging. Methane is approximately 86 times more powerful in its contribution to global warming than carbon dioxide (CO2) over a 20-year time span. Because of this, emissions reduction programs are in place and commonplace in industry. Natural gas systems have numerous sources of fugitive emissions to the atmosphere.

BACKGROUND OF THE INVENTION

This invention relates in general to gas compressions systems, and more particularly to a system for compressing recovered fugitive or intentionally released natural gas emissions, which are comprised of approximately 95% methane, from compression equipment such that they can be directly reintroduced into a pressurized natural gas pipeline system.

SUMMARY OF THE INVENTION

An embodiment of the present invention provides a system for compressing recovered fugitive natural gas emissions such that said emissions can be directly reintroduced into a pressurized natural gas pipeline system. The present invention can include pumps connected to a selector valve, a priority valve, and a speed control assembly.

The pumps can contain cylinders with pistons. The pistons can have a larger center diameter and smaller outer diameters. The pumps can compress the captured natural gas from each side of the pumps. The pumps can also have a gas control assembly to direct high and low-pressured gasses to either end of the drive section in the center of the cylinder assembly to ensure correct operation of the pumps.

The system can contain a spool-type "Priority" valve which determines, based on incoming pressure, whether the pump operates in a single-stage or 2-stage configuration. Said determination is based on the source pressure, which controls the Priority valve position and the routing of gas to be compressed. If the incoming pressure is sufficient to run through a single-stage of compression in order to meet the specified output pressure, the Priority valve is in position 1. As the source pressure decreases, the Priority valve is compelled to position 2, and the gas flows through 2 stages of compression in order to meet the specified output pressure.

The speed control assembly can include a diaphragm or piston-type actuator, or electronic solenoid or servo driven actuator which determines the position of a hydraulic system based on input pressure levels. The hydraulic system limits the amount of travel of an alternating differential-pressure pair of poppet valves which are associated with the drive section of each pump. Pump speed and pumping rate can be modulated by varying the travel of these poppet valves.

Advantages of embodiments of the present invention should be apparent. For example, an embodiment is a fully stand-alone unit requiring no external power other than gas pressures which are readily available at natural gas compressor stations. A preferred embodiment is able to process captured fugitive gases at from very low to moderately high-pressures which are known in the gas pipeline environment. A preferred system runs with low friction due to components and metals used, requires very little maintenance, and returns virtually all presented fugitive emissions to the pipeline in their pure, saleable state. Another advantage of a preferred embodiment is that it may be attached to multiple compressors within a compressor station. Additional advantages and features of the invention will become apparent from the description and claims which follow.

BRIEF DESCRIPTION OF DRAWINGS

The present invention will be better understood on reading the following detailed description of non-limiting embodiments thereof, and on examining the accompanying drawings, in which.

DETAILED DESCRIPTION OF THE INVENTION

Figure 1:
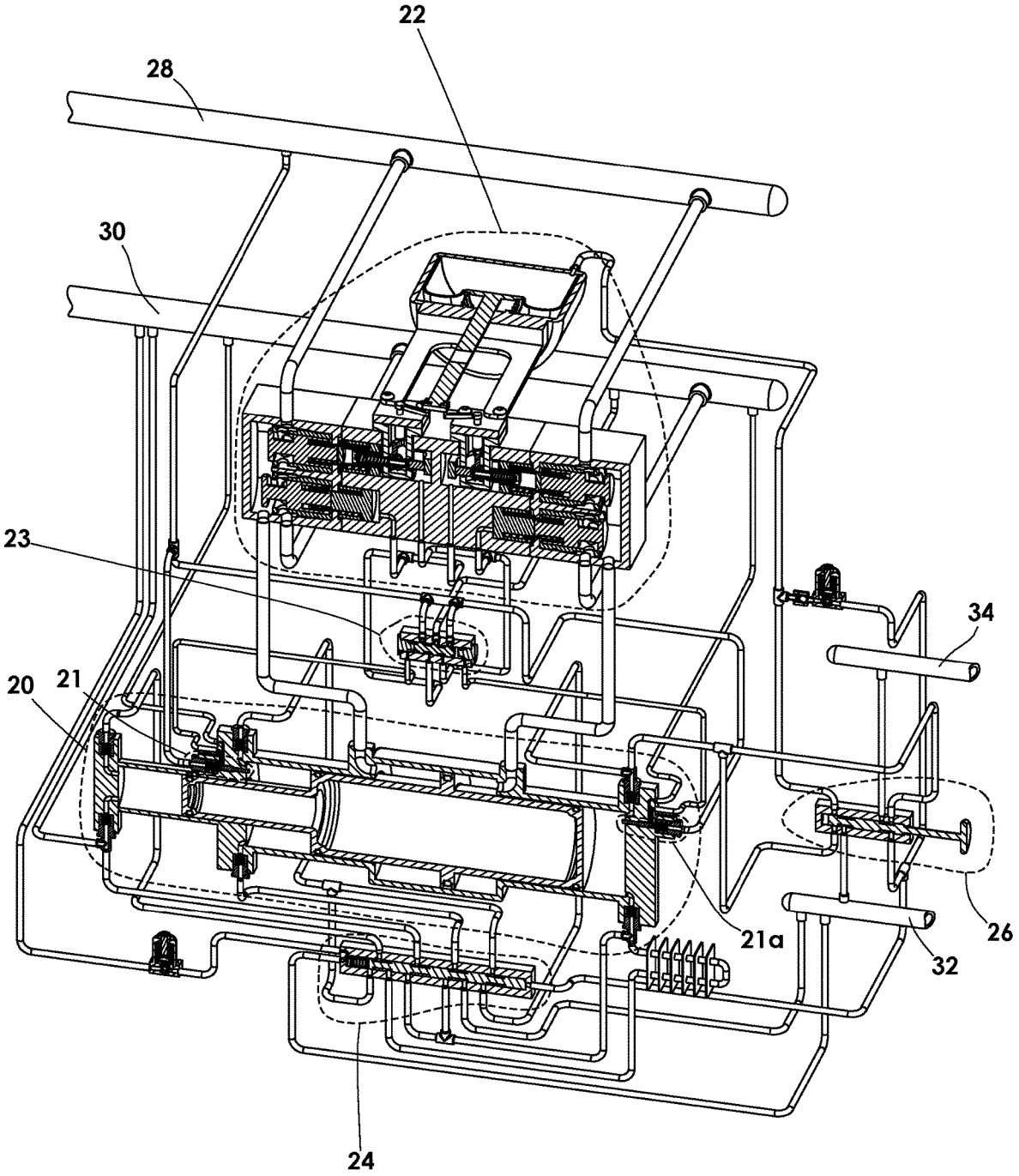
FIG. 1 is an overview of the various assemblies of a gas compression system according to an embodiment of the present invention.

The foregoing aspects, features, and advantages of the present technology will be further appreciated when considered with reference to the following description of preferred embodiments and accompanying drawings, wherein like reference numerals represent like elements. In describing the preferred embodiments of the technology illustrated in the appended drawings, specific terminology will be used for the sake of clarity. The technology, however, is not intended to be limited to the specific terms used, and it is to be understood that each specific term can include equivalents that operate in a similar manner to accomplish a similar purpose.

When introducing elements of various embodiments of the present technology, the articles "a," "an," "the," and "said" are intended to mean that there are one or more of the elements. The terms "comprising," "including," and "having" are intended to be inclusive and mean that there may be additional elements other than the listed elements. Any examples of operating parameters and/or environmental conditions are not exclusive of other parameters/conditions of the disclosed embodiments. Additionally, it should be understood that references to "one embodiment," "an embodiment," "certain embodiments," or "other embodiments" of the present technology are not intended to be interpreted as excluding the existence of additional embodiments that also incorporate the recited features. Furthermore, reference to terms such as "above," "below," "upper," "lower," "side," "front," "back," or other terms regarding orientation are made with reference to the illustrated embodiments and are not intended to be limiting or exclude other orientations.

FIG. 1 presents an overview of the various assemblies that comprise the present technology in a preferred embodiment. The present technology can receive input natural gas from a low-pressure fugitive emissions source or from a pressurized section of pipeline that has been isolated for a Blowdown event and return it to the pipeline. Subsequent figures will depict greater detail. The assemblies are presented here in an order which resembles the flow of gas through the system.

Selector Valve 26 can determine the source of gas to be compressed from either Blowdown Pipeline Source 34 or Low-Pressure Pipeline Source 32 or from other sources. Selector Valve 26 can direct gas to be compressed to Pump Assembly 20 and also can provide pressure to the Speed Control Valving Assembly 22.

Speed Control Valving Assembly 22 can modulate the speed of Pump Assembly 20 based on input gas pressure applied to the diaphragm actuator.

Pump Assembly 20 can be powered by the differential between High-pressure Pipeline 28 and Medium-pressure Pipeline 30, which can be supplied by readily available gas pressures typically found in a natural gas pipeline system. Pump 20 can compress captured input gas and pressurize it sufficiently such that said captured input gas can be reintroduced into Medium-pressure Pipeline 30.

Spool Valve Assembly 23 can direct pressure to alternate sides of the major (drive section) piston within Pump Assembly 20 to compel movement.

Spool Valve Assembly 23 is commanded by a momentary pressure pulse from Trigger Valve Assemblies 21 or 21*a* to provide pilot actuation pressure to Speed Control Valving Assembly 22. This will be explained further.

Priority Valve Assembly 24 can direct Pump Assembly 20 to operate in a 2-stage series mode or single-stage parallel mode based on variable input pressure, in order to achieve a predetermined output pressure.

Figure 2:
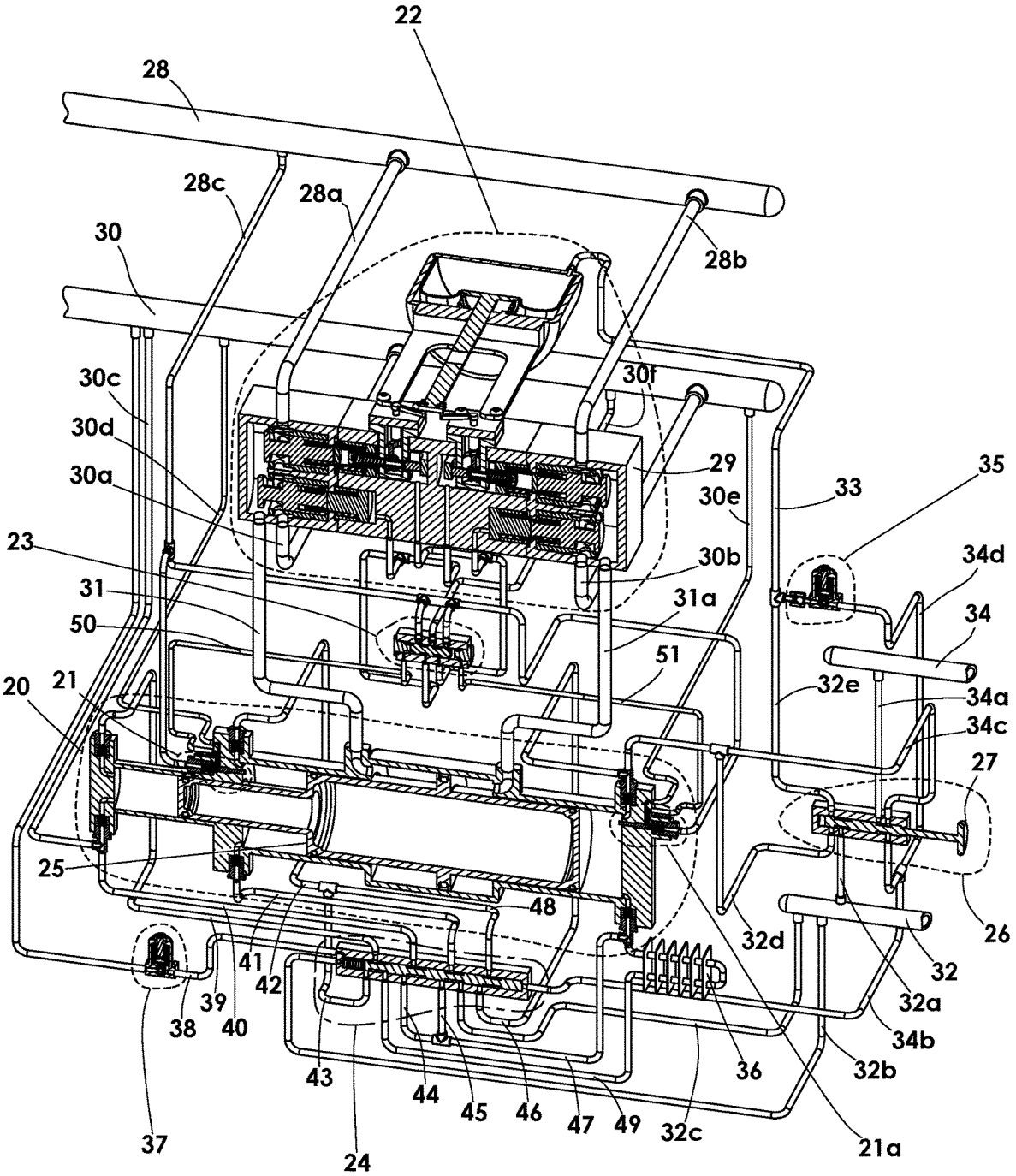
FIG. 2 is a detailed view of interconnections of assemblies of a gas compression system according to an embodiment of the present invention.

FIG. 2 describes the physical connections interconnecting the assemblies presented in FIG. 1, and details of the assemblies.

An embodiment of the Selector Valve Assembly 26 is shown as a spool valve offering 2 spool positions. The source for gas compression can be selected from either Blowdown Pipeline 34 or Low-pressure Pipeline 32 by movement of Selector Knob 27. Other embodiments may have more sources and selections and may be manually or automatically controlled.

An embodiment of Low-pressure Pipeline 32 can be a flow of emissions up to 10 psig captured from a leaking compressor rod packing seal or other low-pressure source, and connected to Selector Valve Assembly 26 via Line 32*a*. Low-pressure captured gas can be sent to the Pump Assembly 20 via Line 32*d* while the pressure from Low-pressure Pipeline 32 can be transmitted to Speed Control Valving Assembly 22 via Line 32*e* and Line 33. Said pressure controls the speed control function of Speed Control Valving Assembly 22.

An embodiment of Blowdown Pipeline 34 can be medium-pressure gas exceeding 500 psig sourced from an isolated section of pipeline as a result of a Blowdown event and is connected to Selector Valve Assembly 26 via Line 34*a*. Said medium-pressure captured gas can be sent to Pump Assembly 20 via Line 34*c* while the pressure from Blowdown Pipeline 34 can be transmitted to Regulator 35 via Line 34*d*.

Regulator 35 can be set to a pre-determined maximum outlet pressure which can correspond with the maximum pump speed setting on Speed Control Assembly 22. Regulator 35 can be connected to Speed Control Valving Assembly 22 via Line 33. When any gas is flowing through Regulator 35 and Line 33, Line 32*e* will be blocked at Selector Valve Assembly 26.

One function of Speed Control Valving Assembly 22 can be to direct gas flow from High-pressure Pipeline 28 and Medium-pressure Pipeline 30 to Pump Assembly 20 through Lines 31 and 31*a*, which can alternately communicate with the High-pressure Pipeline 28 and Medium-pressure Pipeline 30 via valves cycling within Speed Control Valving Assembly 22 as the Spool Valve Assembly 23 cycles. High-pressure Pipeline 28 can be connected to Speed Control Valving Assembly 22 via Lines 28*a* and 28*b*. Medium-pressure Pipeline 30 can be connected to Speed Control Valving Assembly 22 via Lines 30*a* and 30*b*.

Another function of the Speed Control Valving Assembly 22 can be to modulate the speed of Pump Assembly 20. This can be accomplished by applying pressure via Line 33 to a diaphragm actuator, which ultimately controls the flow area through which the gas passes to Pump Assembly 20.

Pump Assembly 20 can connect to the Speed Control Valving Assembly 22 via Lines 31 and 31*a*. Lines 31 and 31*a* provide alternating access to High-pressure Pipeline 28 and Medium-pressure Pipeline 30 via Speed Control Valving Assembly 22 as a power source for compressing gas.

Pump Assembly 20 can contain a reciprocating Compound Piston 25, which can have 4 concentric diametral piston features. The Pump Assembly 20 can combine a pneumatic drive feature with one or two stages of gas compression.

The movement of the Compound Piston 25 can be affected by a pressure differential acting on opposite sides of its largest diameter piston feature. As Compound Piston 25 approaches the end of its linear stroke, Trigger Valves 21 and

21*a* can compel the Spool Valve Assembly 23 to shift to its opposite extreme. Trigger Valves 21 and 21*a* can be connected to High-pressure Pipeline 28 via Line 28*c*. Trigger Valves 21 and 21*a* can be connected to Spool Valve Assembly 23 via Lines 50 and 51. The Spool Valve Assembly 23 can direct pressurized gas to the Speed Control Valving Assembly 22. Speed Control Valving Assembly 22 can modulate the flow of said pressurized gas and can direct said pressurized gas to the correct area of the drive section of Pump Assembly 20.

The Priority Valve Assembly 24 can provide a function of changing the routing of gas to be compressed in Pump Assembly 20 from a series-flow, 2-stage compression mode to a parallel-flow, single-stage compression mode based on input pressure. The System can be designed to compress gas from at least 2 selectable sources. In a preferred embodiment, one source can be a Low-pressure Pipeline 32 that has collected leakage from compressor packing seals or similar. Another embodiment of a source can be an isolated section of pipe for the purpose of "blow down" for maintenance, compressor shut down or start up, such as that depicted in Blowdown Pipeline 34. Blowdown Pipeline 34 can initially have a pressure similar to the pressure in Medium-pressure Pipeline 30. In said embodiment, this blowdown volume can require reduction from medium-pressure, which can be more than 600 psig, to nearly atmospheric pressure. The two aforementioned sources can have very different initial pressure conditions. This System can begin compression of the volume of Blowdown Pipeline 34 in a parallel-flow, single-stage compression mode. This can allow for expeditious compression and evacuation of the Blowdown section of pipe. Once the pressure of the volume within Blowdown Pipeline 34 is reduced to a predetermined level, the limits of single-stage compression are met, necessitating two-stage compression to complete the evacuation of Blowdown Pipeline 34. The Priority Valve Assembly 24 can shift at the threshold point and can alter the flow path through the compression cylinders of the Pump Assembly 20 such that continued compression can take place in a series-flow, 2-stage mode of compression.

Figure 3:
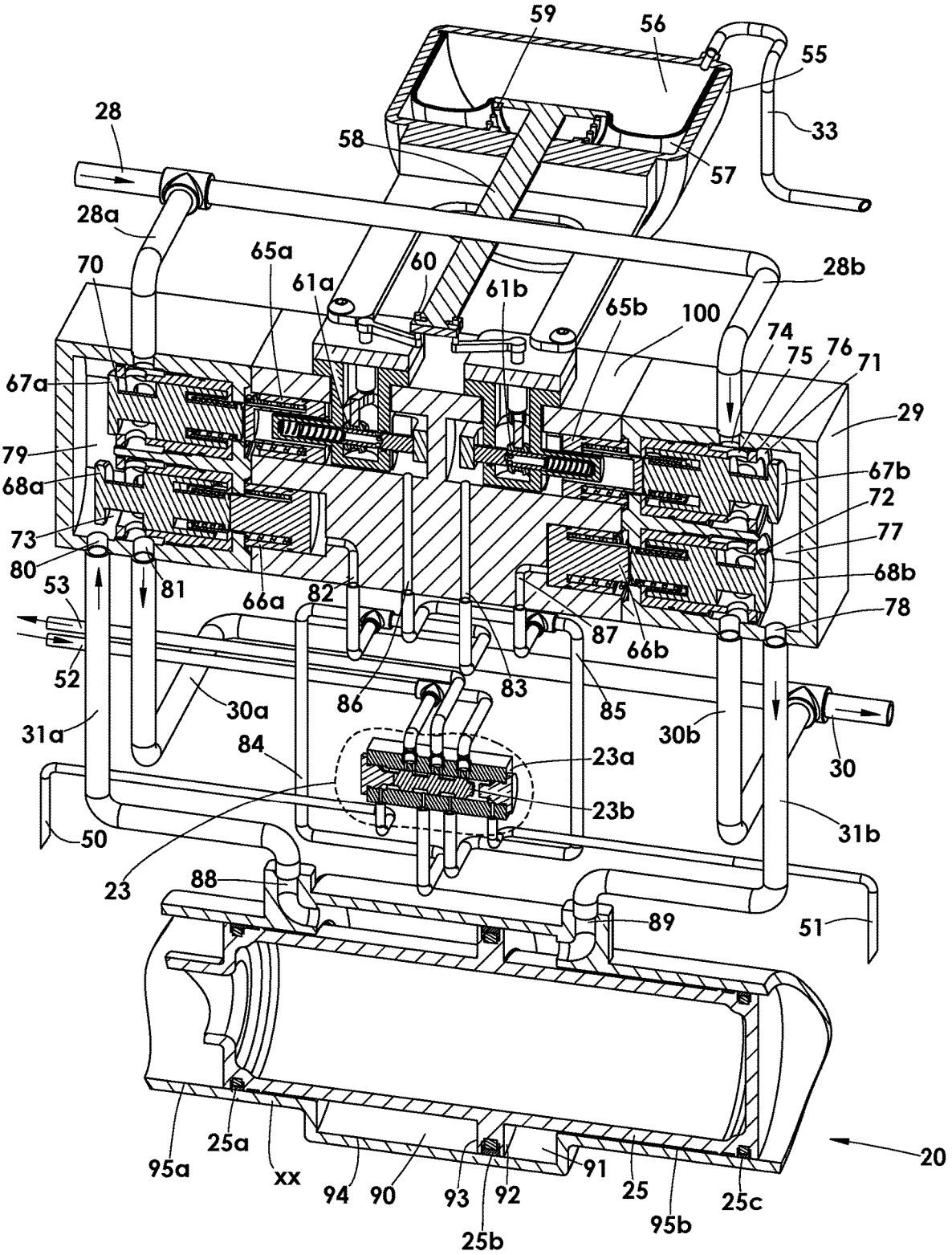
FIG. 3 is another embodiment of assemblies presented in FIG. 2.

FIG. 3 shows an embodiment of the present technology including the Speed Control Valving Assembly 22 (FIG. 1) in the top portion of the page, the Spool Valve Assembly 23 (FIG. 1) in the center of the page, and the Pump Assembly 20 (FIG. 1) at the bottom of the page.

Pump Assembly 20 can contain a reciprocating Compound Piston 25 with 4 diametral features of 3 different sizes. The largest diameter can serve as the driving piston, while the smaller diameters that extend in opposite directions can serve as compression pistons. The driving piston can include a Piston Seal 25*b* that seals against Cylinder Surface 94 as it reciprocates. High-pressure and medium-pressure can flow through Flow Passages 88 and 89. High-pressure gas can flow through Line 31*b* and Flow Passage 89, into Volume 91 and can act against Piston Surface 92, imparting force. As a function of the operation of Speed Control Assembly 22 (in FIG. 2), a medium-pressure can be contained within Volume 90 and can impart a lesser force to Piston Surface 93. This pressure differential acting on opposite sides of the drive piston can result in a net force and movement of the Compound Piston 25 in the leftward direction. The motion of Compound Piston 25 the piston can provide the force necessary to compress gas within the outer piston areas.

The differential pressures alternately added and withdrawn from Volumes 90 and 91 can result from poppet valves being actuated within the Speed Control Assembly 22. FIG. 3 shows opened High-pressure Poppet Valve 67*b* fluidly connected to drive Volume 91 while Medium-pressure Poppet Valve 68*a* can be open and fluidly connected to drive Volume 90.

Once Compound Piston 25 reaches the end of its leftward stroke, it can contact Trigger Valve Assembly 21 (FIG. 2). The Trigger Valve Assembly can then send a momentary high-pressure pulse through Left Side Trigger Valve Line 50 to Spool Valve Assembly 23. This pressure pulse can urge Spool Valve 23*b* to shift to its opposing position within Spool Valve Housing 23*a*. The Spool Valve Assembly 23 can be connected to High-pressure Line 52 and Medium-pressure Line 53 and can route these pressure sources to the correct Flow Lines 84 and 85, depending on the direction that Compound Piston 25 needs to travel. As shown in FIG. 3, Spool Valve Assembly 23 (FIG. 1) can apply high-pressure to Flow Line 84 and through Flow Passages 82 and 83. This high-pressure can exert sufficient force against Valve Actuation Pistons 66*a* and 65*b*. This can cause the opening of Poppet Valves 68*a* and 67*b*, respectively. Concurrently, Flow Line 85 can be fluidly connected with medium-pressure gas Flow Passages 86 and 87. The medium-pressure can exert forces on Valve Actuation Pistons 67*a* and 68*b*, but these forces must be lower than the spring forces holding the valves closed. Viewing Flow Areas 70 and 72, it can be apparent that those valves are closed and not flowing.

High-pressure gas can flow in High-pressure Pipeline 28, Line 28*b*, through Flow Passage 74, Open Valve Flow Area 71 and into Volume 77. The flowing gas can then flow through Flow Passage 78, Line 31*b*, Flow Passage 89, and into Volume 91, where it can exert force against Piston Surface 92. FIG. 3 also shows that medium-pressure in Volume 90 can be exhausted by Piston Surface 93 of the leftward moving Compound Piston 25. Said exhaust gas can flow through Flow Passage 88, Line 31*a*, Flow Passage 80 and into Volume 79 before flowing through Open Valve Flow Area 73. Said exhaust gas can then flow through Flow Area 81 and into Line 30*a* and Medium-pressure Pipeline 30. When the Compound Piston 25 contacts the Trigger Valve at the left end of its stroke, these valve movements and pressures can be reversed in order to drive the piston rightward.

A preferred embodiment of the present technology can have an important variable-speed attribute that can allow methane leakage mitigation to be precisely accomplished according to demand. If capture and compression of methane exceeds the rate of leakage, dilution of the gas with atmospheric air can occur. Therefore, it is imperative that the speed of Pump Assembly 20 can correspond with the leakage rate and can automatically adjust its pumping speed accordingly. The speed of the Pump Assembly 20 can be regulated by varying the magnitude of opening of high-pressure Poppet Valves 67*a* and 67*b*. The speed control actuator can consist of Actuator Housing 55, Actuator Diaphragm 57, Actuator Spring 59 and Actuator Rod 58. Low-pressure of 0-10 psig from the leakage source can flow through Line 33 and into Volume 56. The force acting on the Actuator Diaphragm 57 can be opposed by Actuator Spring 59. The Actuator Rod 58 can contain two forked features at its end that can engage the cylindrical feature of Bell Crank 60. Rotation of the two Bell Cranks shown by linear displacement of Actuator Rod 58 can effect change of pump speed. As the pressure in Volume 56 increases, the diaphragm can move and can increase the volume within Volume 56 and can also compress Actuator Spring 59. At 0 psig pressure in Volume 56, the diaphragm cannot move and the system cannot function. Speed and leakage mitigation rate can increase linearly to 100% as the pressure in Volume 56 reaches its maximum design pressure.

Figure 4:
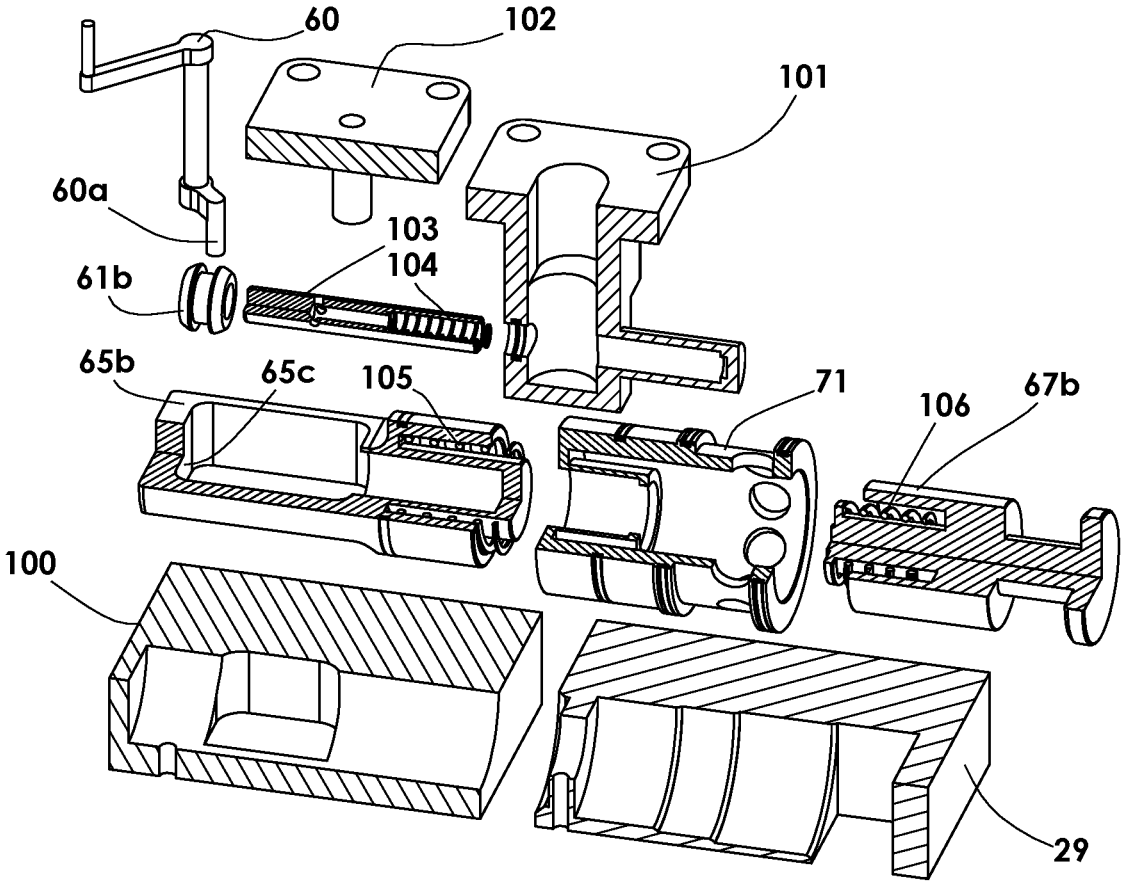
FIG. 4 is an exploded view of the Poppet Valve system with hydraulic valve travel feature that is explained in FIGS. 5-8

FIG. 4 displays an embodiment of High-pressure Poppet Valve 67*b* and other hardware that can be related to the variable-speed function of this invention. This exploded view is intended to show individual components that can comprise the assembly. Of particular note in FIG. 4 is Internal Opposing Face 65*c* which is within High-Pressure Valve Actuation Piston 65*b*. The functions and descriptions of these components can be displayed in FIGS. 5-8 and the accompanying descriptive text.

FIGS. 5,6,7, and 8 are presented to introduce this invention's method of pump speed control.

Figure 5:
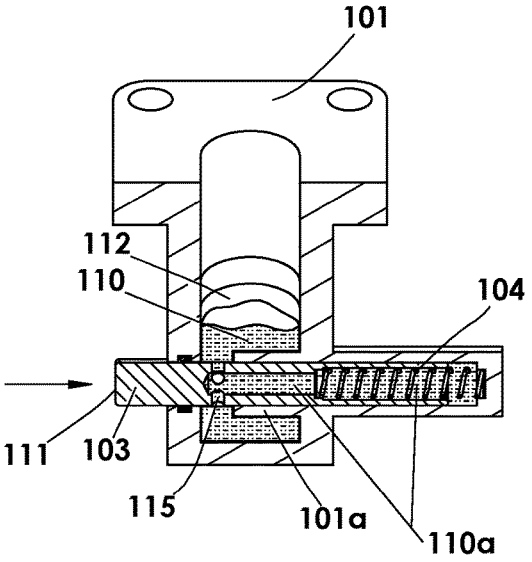
FIGS. 5-8 are presented to introduce this invention's method of pump speed control.
Figure 6:
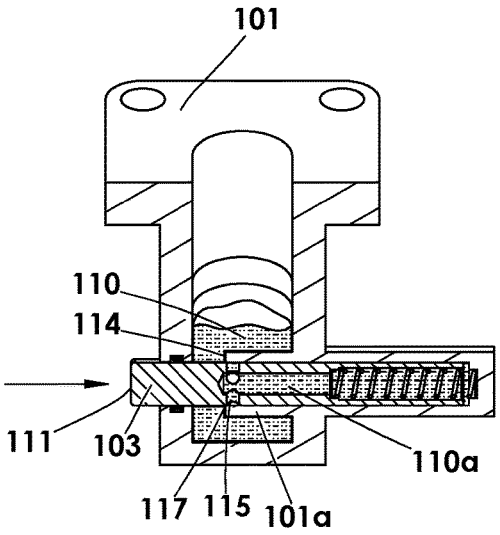

FIG. 5 and FIG. 6 display an embodiment of Solid Sleeve 101*a* for the sake of explanation, although it is not a preferred embodiment.

FIG. 5 depicts Plunger 103 installed into its bore within Plunger Housing 101. The housing can contain a finite volume of incompressible Fluid 110. Plunger 103 can be hollow from its right end to provide a cavity for Spring 104 and a flow passage that can fluidly communicate with multiple cross-drilled Bleed Holes 115. In the position shown in FIG. 5, the Fluid 110 can reside in the Vented Reservoir 112 and can occupy the internal volume of Plunger 103 and the plunger bore volume of Plunger Housing 101. Plunger Housing 101 can be fixed and immovable. If a force is applied to the End Face 111 of Plunger 103 that exceeds the preload force of Spring 104, the Plunger can move deeper into its bore within Plunger Housing 101. As the plunger is forced into its bore, Fluid 110*a* can be displaced from the internal volumes of the plunger and plunger bore through the Bleed Holes 115 and into the Vented Reservoir 112.

FIG. 6 depicts Plunger 103 moved rightward into the bore within Plunger Housing 101 until Bleed Holes 115 can be entirely blocked at location 117 as they move past the End Surface 114 of Solid Sleeve 101*a*. At this point, Fluid 110*a* can be trapped inside the internal volume of Plunger 103 and the internal bore of Plunger Housing 101. The movement of the Plunger 103 can halt within immovable Plunger Housing 101 due to the trapped incompressible Fluid 110*a*. The diametral clearance between the plunger and bore can be quite small, negating leakage.

Figure 7:
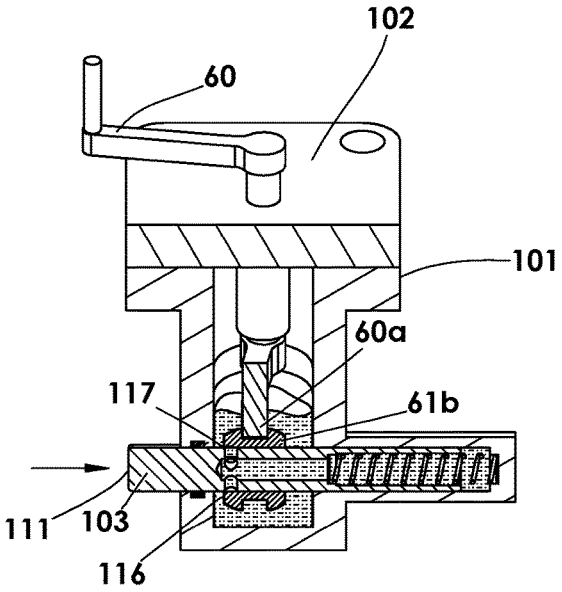

FIG. 7 is a preferred embodiment that can depict Solid Sleeve 101*a* (FIGS. 5 & 6) replaced by Moveable Sleeve 61*b*. Plunger 103 can be moved in a rightward direction due to force applied to End Face 111. Movement has been arrested, as End Face 116 of Moveable Sleeve 61*b* entirely blocks Bleed Holes 115 (FIG. 6) at location 117. Moveable Sleeve 61*b* can contain an external annular grove that can be engaged by the lowest offset cylindrical portion of Bell Crank 60*a*. Bell Crank 60 can be contained within and guided by Bell Crank Housing 102. The axial position of Moveable Sleeve 61*b* along Plunger 103 can be controlled by the position of Bell Crank 60. The position of Bell Crank 60 can be determined by the pressure acting upon the speed control diaphragm which can be linearly proportional to leakage rate.

Figure 8:
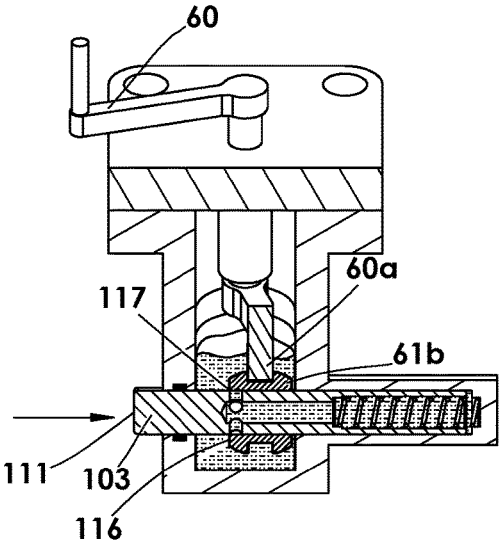

FIG. 8 displays the same embodiment as FIG. 7. In this depiction the arrested motion can be moved farther to the right because Bell Crank 60 can be rotated and Moveable Sleeve 61*b* can be moved accordingly. This can result in a more distant linear displacement of Plunger 103 to the right, prior to arrested movement.

Figure 9:
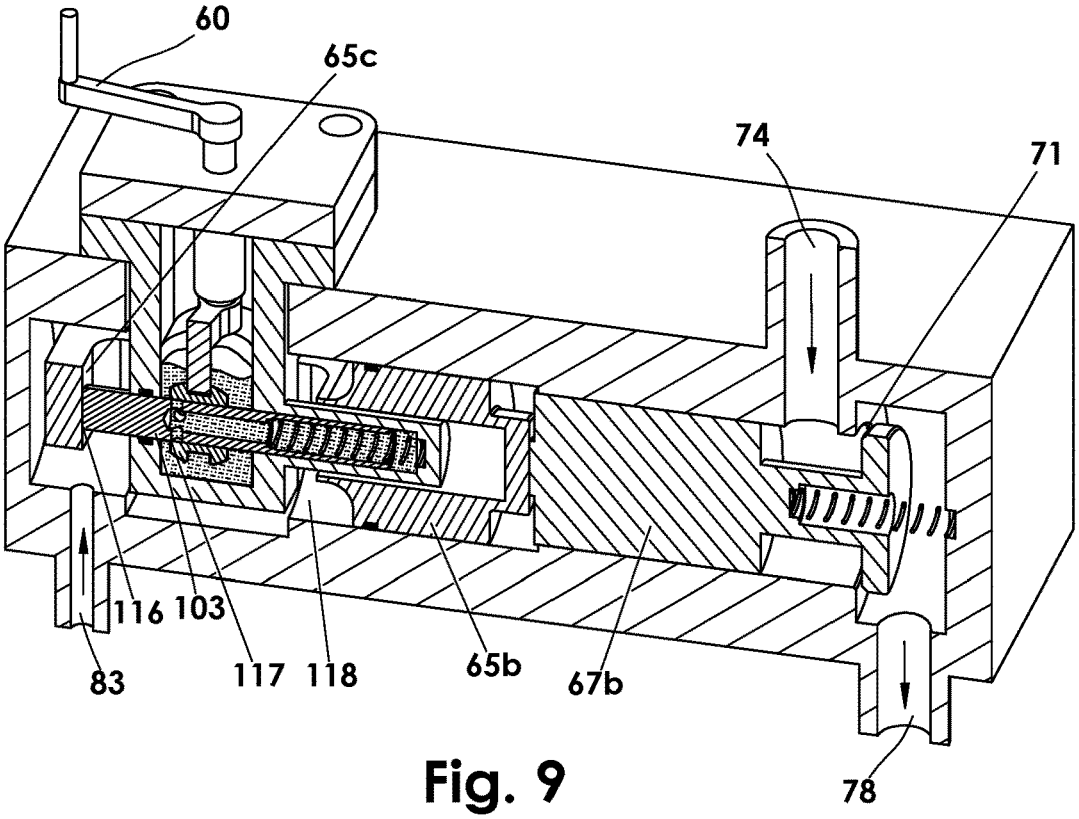
FIGS. 9 and 10 demonstrate the effect that rotation of Bell Crank 60 has on the lift of High-pressure Poppet Valve 67*b*.
Figure 10:
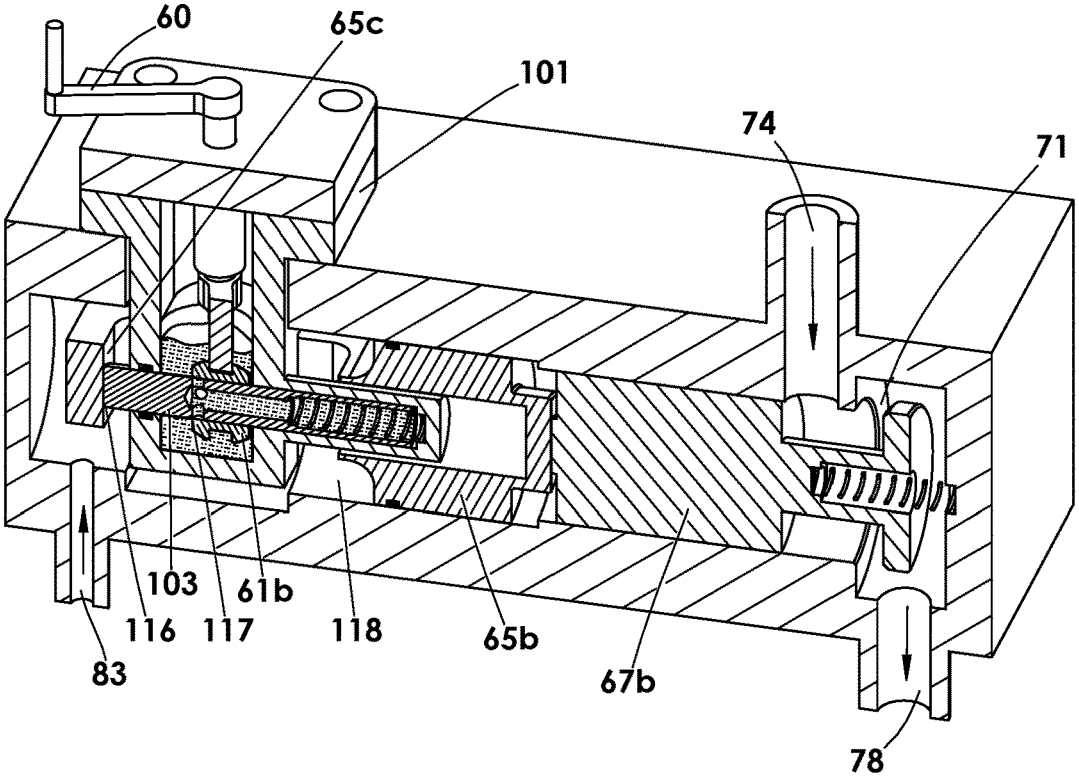

FIGS. 9 and 10 further illustrate the effect of movement of Bell Crank 60 on the linear displacement of Poppet Valve 67*b*.

FIG. 9 depicts slight movement of Bell Crank 60 as evidenced by the position of High-Pressure Poppet Valve 67*b*. High-pressure can flow through Passage 83 and into Volume 118 and can act upon the diametral area of High-Pressure Valve Actuation Piston 65*b*. The force due to the application of this pressure can cause High-Pressure Poppet Valve 67*b* to open. The opening event can be arrested by the contact of Internal Opposing Face 65*c* with end face of Plunger 103 at location 116. In this depiction, Poppet Valve 67*b* can allow only a limited amount of flow through Open Valve Flow Area 71.

FIG. 10 depicts the effect of Bell Crank 60 in its fully open position and the corresponding linear displacement of Moveable Sleeve 61*b*. In this depiction Plunger 103 can move deeper into its bore within Plunger Housing 101 to the point of arrested movement. High-pressure Poppet Valve 67*b* can achieve its fully open position, allowing the maximum amount of flow through Open Valve Flow Area 71.

Figure 11:
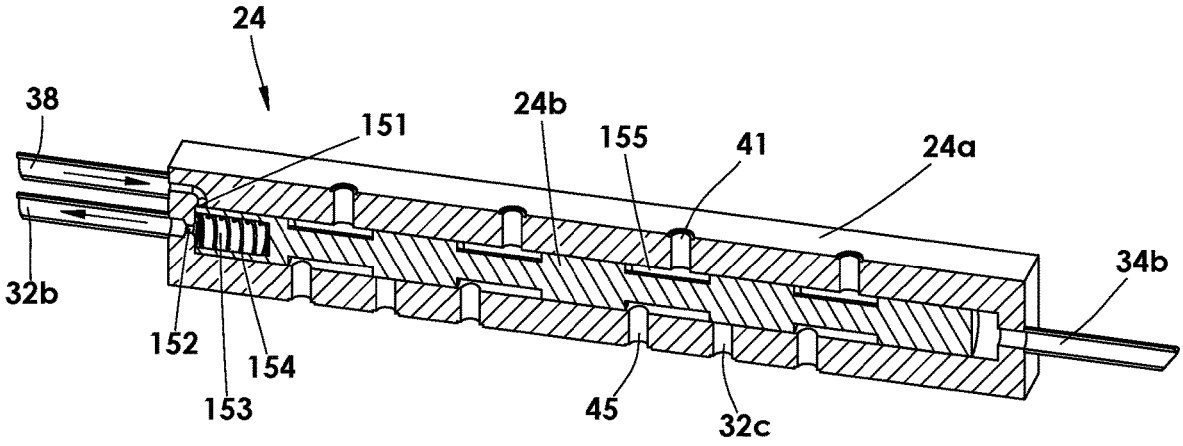
FIGS. 11, 12 and 13 illustrate the different gas routing paths of the Priority Valve Assembly utilizing parallel single-stage compression and series-flow 2-stage compression.
Figure 12:
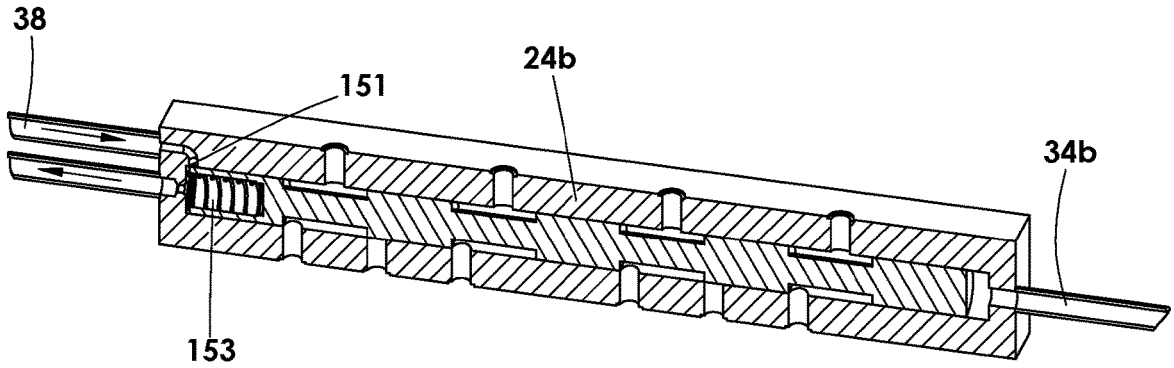
Figure 13:
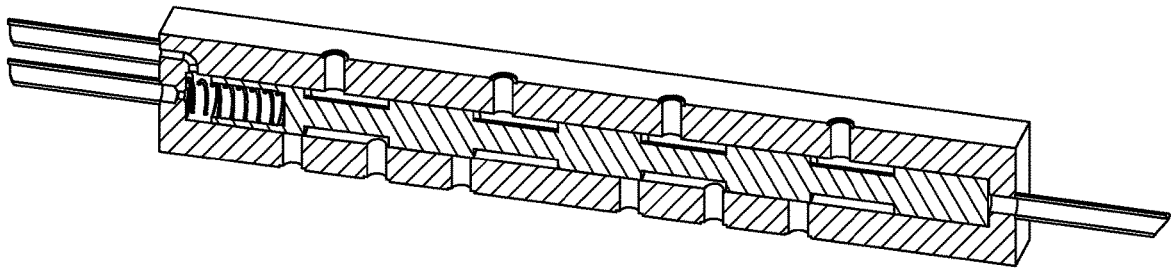

FIGS. 11, 12 and 13 depict embodiments of the present technology which are presented to illustrate the functionality of the Priority Valve Assembly 24.

FIG. 11 depicts the two primary components that comprise Priority Valve Assembly 24, Priority Valve Housing 24*a*, and Priority Spool Valve 24*b*. This assembly can have four valving sections, as evidenced by the four annular grooves apparent on Priority Spool Valve 24*b*. Shifting of the spool valve from its right most position to its left most axial position can change the valving connections in each of the four valving sections. Viewing Annular Groove 155, Flow Passages 41 and 45 are fluidly connected, while Flow Passage 32*c* can be blocked from fluid communication with other passages.

The purpose of the Priority Valve Assembly 24 can be to automatically select and route gas for either parallel-flow single-stage compression or series-flow two-stage compression, based on the inlet pressure to the pump. FIG. 11 can show the Priority Spool Valve 24*b* in its left most position, a position that can route gas for parallel-flow, single-stage compression because at the start of a blowdown mitigation process, the pressure in Line 34*b* is at its highest. During the blowdown process, the pressure in Blowdown Pipeline 34 can decrease as the finite volume of blowdown gas is compressed and admitted to its destination Medium Pressure Pipeline 30 (FIG. 1).

In order for the Priority Spool Valve 24*b* to be urged and held in its left most position, the force acting on the right face of said spool valve due to the pressure of Line 34*b* must exceed the force of the Spring 154 and the force acting on the left face due to pressure in Volume 153. When the spool valve is at its left most position, pressure in Volume 153 is low as regulated pressure in Line 38 can be blocked from fluid communication with Volume 153 due to the outer diameter of the spool valve blocking the flow passage at Location 151. Line 32*b* can be fluidly connected to Low Pressure Pipeline 32 (FIG. 1) and can be fluidly connected to Volume 153 through Orifice 152.

FIG. 12 depicts the transition that occurs once the pressure in Line 34*b* and the pressure within Blowdown Pipeline 34 has decreased to the point that forces acting on the left end of Priority Spool Valve 24*b* are higher than the force on the right end of Priority Spool Valve 24*b*. Priority Spool Valve 24*b* can move rightward a small amount such that the flow passage from pressurized Line 38 can be fluidly connected to Volume 153 at Location 151 which can result in a pressure increase within Volume 153. Said pressure increase can result in a positive shifting of the Priority Spool Valve 24*b* from its leftmost position to its rightmost position. In the rightmost position the flow routing of gasses through the compressor can compel a transition of Pump Assembly 20 (FIG. 1) to series-flow, two-stage compression mode.

FIG. 13 depicts the Priority Spool Valve 24*b* in its right most position, series-flow, two-stage compression.

Figure 14:
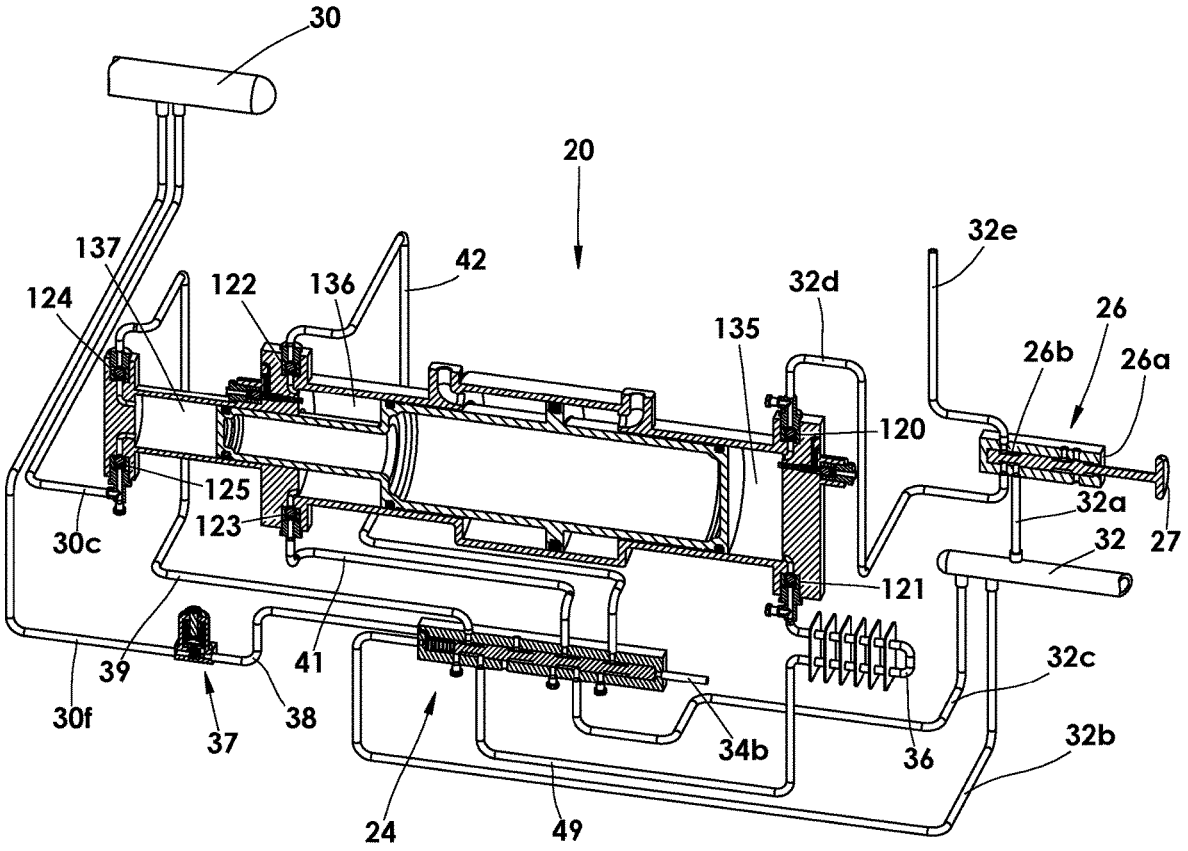
FIGS. 14, 15 and 16 are embodiments of the present technology which depict the functionality of the Priority Valve Assembly.
Figure 15:
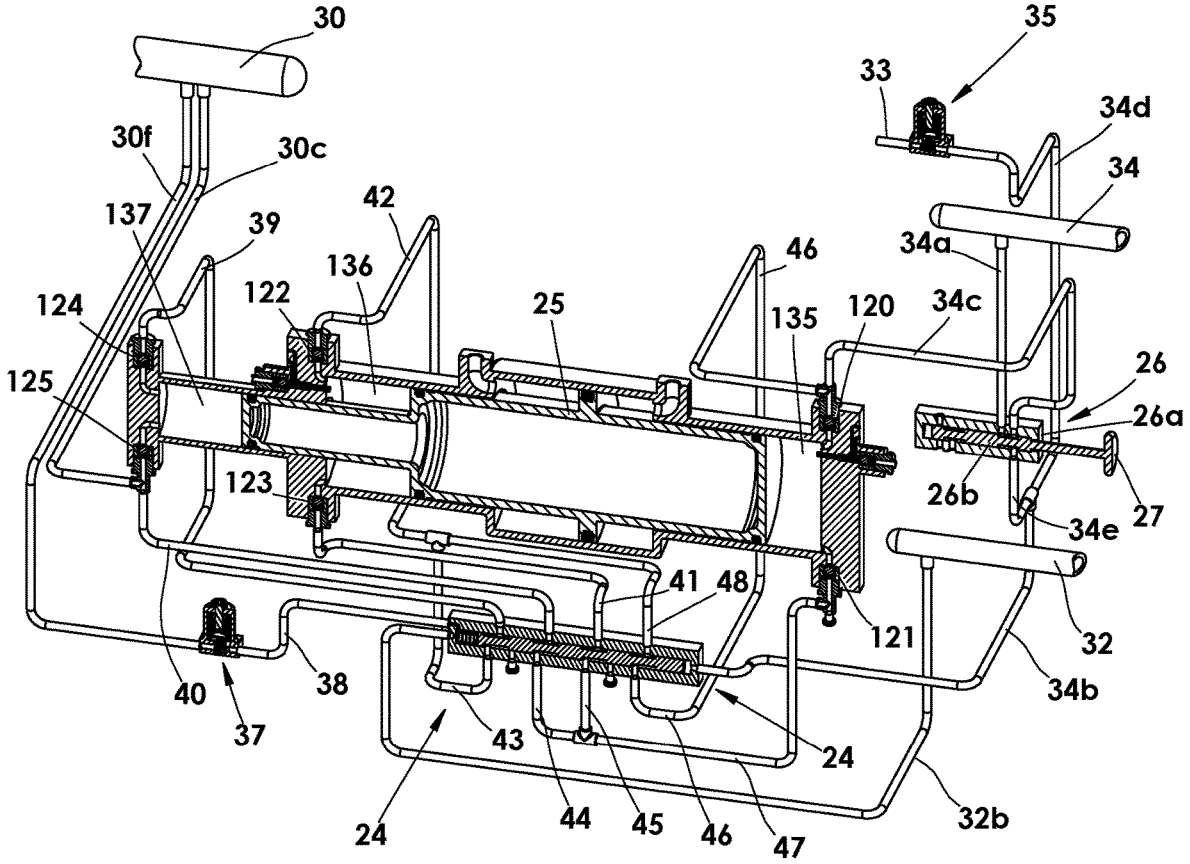
Figure 16:
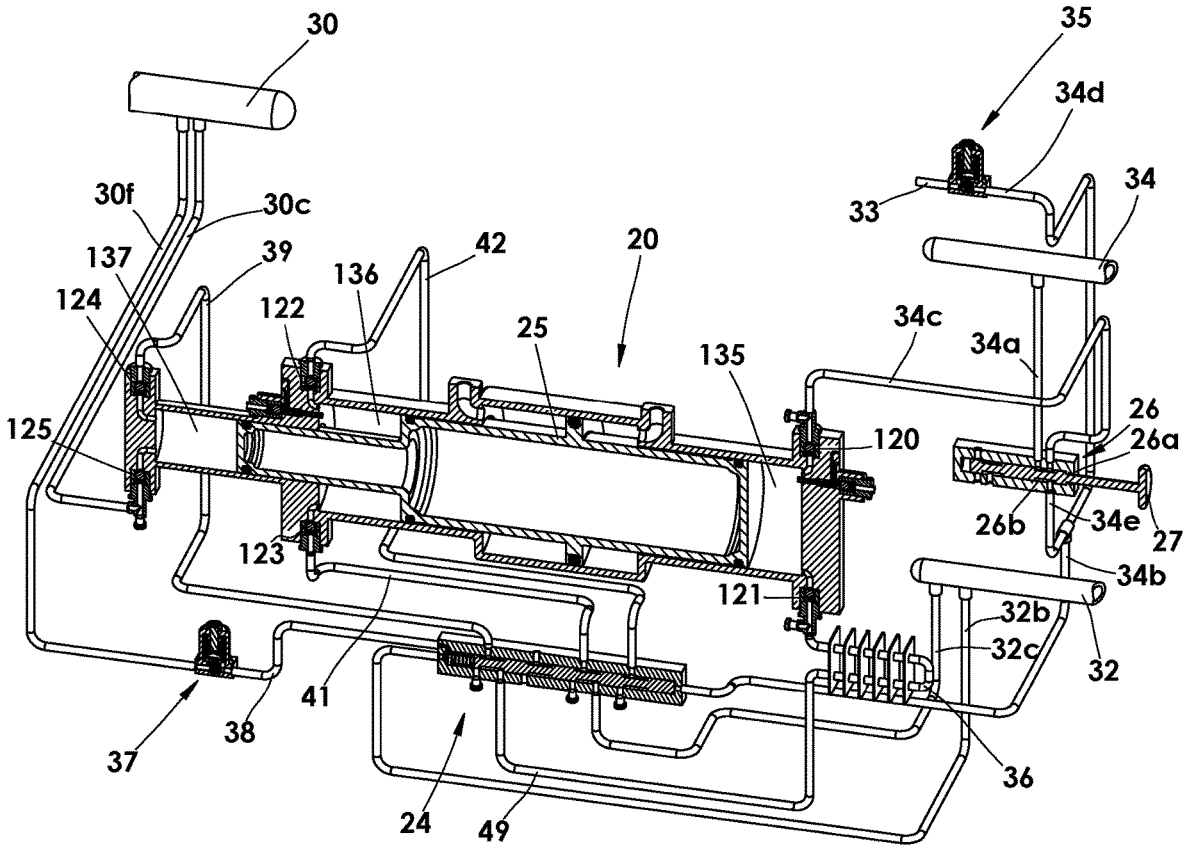

FIGS. 14, 15 and 16 are embodiments of the present technology which depict the functionality of the Priority Valve Assembly 24.

FIG. 14 depicts an embodiment of Pump Assembly 20 as it compresses gas from Low Pressure Pipeline 32. When compressing low pressure gas up to the medium pressure required to insert said gas into Medium Pressure Pipeline 30, series-flow, 2-stage compression is required. Priority Spool Valve 24*b* (FIG. 11) can be in its de-actuated right-most position. This will be the case because Line 34*b* can be blocked in Selector Valve Assembly 26, receiving no actuation pressure. In said position, Pump Assembly 20 can use a series-flow, 2-stage configuration, wherein the right side of Pump Assembly 20 performs the first stage of compression and the smallest piston on the left-most side of Pump Assembly 20 can perform the second stage of compression. Lines that are not in use for this configuration have been omitted from FIG. 14 for clarity.

Selector Knob 27 is depicted in its left-most, inward position. In said position, passage 26*b* can be open on the left side of Selector Valve 26. Said position can allow fluid connectivity of the volume of Low Pressure Pipeline 32 via Line 32*a* to Lines 32*d* and 32*e*. Line 32*e* can be connected to Speed Control Actuator Housing 55 (FIG. 3) to modulate the speed of Pump Assembly 20. Line 32*d* can be connected to Inlet Valve 120 on the right side of Pump Assembly 20. As Compound Piston 25 moves to the left, it can draw in the low-pressure volume of gas through Inlet Valve 120. As the piston then moves to the right, the trapped gas in Volume 135 can undergo its first stage of compression and can then be pumped through Discharge Valve 121 and through Intercooler 36. From Intercooler 36 the gas can travel via Line 49, thru the internal passage within Priority Valve Assembly 24 to Line 39, Inlet Valve 124 and into 2nd-stage cylinder Volume 137. The reciprocation of Compound Piston 25 can result in gas displacement into Volume 137 through Inlet Valve 124 and can discharge through Discharge Valve 125 to Line 30*c* and into Medium Pressure Pipeline 30.

While operating in series-flow, two-stage compression mode, the first-stage compression feature of the left side of Pump Assembly 20 must be disabled and forced to operate below atmospheric pressure. Because substantial force can be required of the Compound Piston 25 to perform second-stage compression within Volume 137, load must be minimized on the piston due to compression or expansion of trapped gas in Volume 136. In this operational mode, the inlet Line 42 can be blocked within Priority Valve Assembly 24 and the outlet Line 41 can be fluidly connected through Line 32*c* to Low Pressure Pipeline 32. This configuration can allow for minimum pressure within compression Volume 136 throughout the operating cycle.

FIG. 15 depicts an embodiment of the present technology functioning in parallel-flow, single-stage compression of a pre-determined volume of medium pressure gas contained within Blowdown Pipeline 34. Lines that are not in use for this configuration have been omitted for clarity.

Pressure of said pre-determined gas volume can initially be at or near the pressure of Medium Pressure Pipeline 30, whereby only a single stage of compression is necessary to insert said gas into Medium Pressure Pipeline 30. Gas can flow from Blowdown Pipeline 34, through Line 34*a* into Selector Valve 26. Line 34*e* is fluidly connected to Line 34*d*, Regulator 35, and Line 33. Line 33 can be connected to Speed Control Actuator Housing 55 (FIG. 3) for the purpose of modulating the speed of Pump Assembly 20 (FIG. 1), once the pressure within Blowdown Pipeline 34 falls below the set point of Regulator 35.

In this operational mode the three compression Volumes, 135, 136, and 137, can all receive inlet flow from fluidly connected Blowdown Pipeline 34 and can discharge into Medium Pressure Pipeline 30. Line 34*c* can flow through Inlet Valve 120, and into Volume 135. The tee connection atop Inlet Valve 120 can be connected via Line 46 to Line 48. Line 48 can connect to Lines 42 and 43. Line 42 can flow through Inlet Valve 122 and into Volume 136. Line 43 can be fluidly connected to Line 39 through Inlet Valve 124 and into Volume 137. Each compression Volume, 135, 136, and 137, can discharge compressed gas through their respective Discharge Valves, 121, 123, and 125, through Lines 47, 41, and 40, respectively. These three compressed discharges can all fluidly connect and flow into Medium Pressure Pipeline 30.

FIG. 16 depicts an embodiment of the present technology whereby the system can shift from parallel-flow single-stage compression to series-flow two-stage compression as incoming pressure from Blowdown Pipeline 34 can decrease due to a reduction in the source volume. Lines that are not in use for this configuration have been omitted from FIG. 16 for clarity. The difference between FIG. 15 and FIG. 16 can be depicted by the different flow paths that are operational once the Priority Valve Assembly 24 has shifted to series-flow, two-stage compression. Said shift can be necessitated once the pressure differential between Blowdown Pipeline 34 and Medium Pressure Pipeline 30 becomes too large for single-stage compression.

Pressurized gas can flow from Blowdown Pipeline 34, through Line 34*a* into Selector Valve 26. Line 34*e* can be fluidly connected to Line 34*d*, Regulator 35, and Line 33. Line 33 can be connected to Speed Control Actuator Housing 55 (FIG. 3) for the purpose of modulating the speed of Pump Assembly 20, once the pressure within Blowdown Pipeline 34 falls below the set point of Regulator 35.

Selector Knob 27 can be in its right-most, outward position. In said position, passage 26*b* can be open on the right side of Selector Valve 26. Said position can allow fluid connectivity of the volume of Blowdown Pipeline 34 via Line 34*a* to Lines 34*c* and 34*e*. Line 34*c* can be connected to Inlet Valve 120 on the right side of Pump Assembly 20. As Compound Piston 25 moves to the left, it can draw in the low-pressure volume of leaked gas through Inlet Valve 120. As the piston moves to the right, the gas in Volume 135 can undergo a first stage of compression. Said gas can be pumped through Discharge Valve 121 and through Intercooler 36. From Intercooler 36 the gas can travel via Line 49, through the internal passage within Priority Valve Assembly 24, to Line 39 and then to Inlet Valve 124 and into 2nd-stage cylinder Volume 137. The reciprocation of Compound Piston 25 can result in gas intake into Volume 137 through Inlet Valve 124 and discharge through Discharge Valve 125 to Line 30*c* and into Medium Pressure Pipeline 30.

The invention claimed is:

1. A system that enables captured fugitive gas emissions consisting primarily of methane gas to be compressed such that the captured fugitive gas emissions are re-introduced into a natural gas pipeline system, comprising:

a pump, containing one or more cylinders containing one or more pistons with a major diameter in a center of the one or more cylinders and two or more minor diameters situated distally opposed from the center in an axial direction, wherein diameters are concentric within the one or more cylinders, wherein each end of the one or more cylinders contains a cylinder head configured for suctioning and discharging said captured fugitive gas emissions with movement of the one or more pistons;

a drive section inlet, said drive section inlet being coupled to said natural gas pipeline system on a high pressure side of at least one natural gas compressor, said drive section inlet operable to facilitate introduction of compressed natural gas from said natural gas pipeline system into the drive section of the pump;

a drive section discharge port, said drive section discharge port being operably coupled to a low pressure side of said at least one natural gas compressor;

a captured fugitive emissions gas inlet, said captured fugitive emissions gas inlet being operably coupled to receive gas from a captured fugitive emissions source, said captured fugitive emissions gas inlet having tubing coupled thereto, said tubing configured to direct gas into the captured fugitive emissions gas inlet;

a captured fugitive emissions compressed gas discharge port, said captured fugitive emissions compressed gas discharge port being operably coupled to said low pressure side of said at least one natural gas compressor;

a selector valve fluidly connected to the pump, said selector valve operably coupled to isolated pipe sections upstream and downstream of one compressor of the at least one natural gas compressor to be isolated for blowdown and maintenance, said selector valve additionally operably coupled to receive said captured fugitive emissions gas, said selector valve also operably coupled to discharge said captured fugitive emissions gas to said captured fugitive emissions gas inlet, said selector valve also operably coupled to discharge said captured fugitive emissions gas to a speed control assembly;

said speed control assembly fluidly connected to the selector valve and the pump, said speed control assembly containing a plunger, a plunger housing and a spring, said plunger housing containing a finite volume of incompressible fluid, said plunger being hollow at a first end to provide a cavity for said spring, said plunger containing a flow passage that can fluidly communicate with multiple cross-drilled bleed holes, movement of said plunger being halted within said plunger housing when said bleed holes are covered to prevent the escape of said finite volume of incompressible fluid;

said speed control assembly also containing a moveable sleeve, said moveable sleeve allowing a variable distance between said bleed holes and said plunger housing as said moveable sleeve is moved;

said speed control assembly also containing a bell crank and bell crank housing, said bell crank controlling an axial position of said moveable sleeve along said plunger, the axial position of said bell crank determined by pressure acting upon one of a diaphragm, a piston-type actuator, an electronic solenoid, or a servo driven actuator; and a priority valve fluidly connected to the pump, containing a spring on a first side of the priority valve which biases the priority valve to move to a first position which allows two-stage, series-flow operation of the pump;

said priority valve also containing a second gas inlet on a second side of the priority valve fluidly connected to the selector valve which biases the priority valve at a predetermined pressure to overcome the bias of the spring and move to said priority valve to a second position which allows single-stage, parallel-flow operation of the pump;

said priority valve also containing a first gas inlet on the first side of the priority valve which works in conjunction with the spring to urge the priority valve to the first position at the moment the spring bias overtakes a pressure on the second side;

said priority valve also containing a fluid connection during the two-stage operation between the priority valve and the two or more minor diameters of the piston on a first side of the pump which brings a volume of the one or more cylinders containing the two or more minor diameters of the piston on the first side of the pump to substantially atmospheric pressure, removing a load acting on said two or more minor diameters of the one or more pistons.

2. The system of claim 1 wherein the pump further comprises:

a gas control assembly comprising a spool-type valve to direct high pressure gas sourced from said high pressure side of said at least one natural gas compressor alternately to opposite sides of the major diameter of said one or more pistons to drive the one or more pistons in a direction opposite of a side where the higher-pressure gas is applied, said gas control assembly also operably coupled to said low pressure side of said at least one natural gas compressor which imparts a lesser force to create a pressure differential; said pressure differential based on a predetermined size of said major diameter of said one or more pistons providing a net force required for operation and movement of the pump;

said direction based on one or more mechanically actuated trigger valves located within said one or more cylinder heads, said one or more mechanically actuated trigger valves being operably coupled to said gas control assembly, said one or more mechanically actuated trigger valves providing a momentary high-pressure pulse to said gas control assembly to bias said spool-type valve to its opposite position.

3. The pump of claim 2 further comprising:

an additional minor diameter cylinder of the one or more cylinders containing a minor diameter piston of the one or more pistons and a cylinder head of the one or more cylinder heads which utilizes discharged gas from one or more of the cylinder heads as input gas, controlled by a position of the priority valve to change the operation of the pump from the single-stage parallel operation to the two-stage series operation to achieve a pre-determined output pressure.

4. The system of claim 1 wherein the speed control assembly further comprises:

an assembly whose operation is controlled by a position of said one of said diaphragm, said piston-type actuator, said electronic solenoid, or said servo driven actuator, said position being controlled by input gas pressure from the selector valve, wherein said one of said diaphragm, said piston-type actuator, said electronic solenoid, or said servo driven actuator determines a flow area of a valve to activate, de-activate, and modulate the speed of the pump.

5. The system of claim 1 wherein the selector valve further comprises:

a valve assembly allowing the selection of the captured fugitive emissions source to be compressed, said captured fugitive emissions source being captured fugitive emissions gas from said at least one natural gas compressor's piston rod packing seal assembly, gas under pressure to be purged in a blowdown event, or other leakage sources found in said natural gas pipeline system;

a pressure monitoring discharge port fluidly connected to a regulator, said regulator fluidly connected to said speed control assembly, said regulator set to a predetermined maximum outlet pressure which corresponds with a maximum pump speed setting on said speed control assembly; and a gas discharge port fluidly connected to said captured fugitive emissions gas inlet of said pump.

6. The system of claim 1 wherein the priority valve further comprises:

a pressure-driven spool-type valve which controls routing of gases through the pump, wherein an input pressure received from said selector valve automatically controls the priority valve to actuate the single-stage, parallel flow operation or the two-stage, series flow operation to achieve a predetermined output pressure, a position of a spool of said priority being determined by said input pressure.

* * * * *